US006902150B2

(12) United States Patent
Alberson et al.

(10) Patent No.: US 6,902,150 B2
(45) Date of Patent: Jun. 7, 2005

(54) STEEL YIELDING GUARDRAIL SUPPORT POST

(75) Inventors: Dean C. Alberson, Bryan, TX (US); D. Lance Bullard, Jr., College Station, TX (US); C. Eugene Buth, College Station, TX (US); Roger P. Bligh, Bryan, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/308,296

(22) Filed: Dec. 2, 2002

(65) Prior Publication Data

US 2003/0151038 A1 Aug. 14, 2003

Related U.S. Application Data

(60) Provisional application No. 60/334,286, filed on Nov. 30, 2001.

(51) Int. Cl.[7] ..... E01F 15/00

(52) U.S. Cl. ..... 256/13.1; 404/6; 404/9; 404/10

(58) Field of Search ..... 256/1, 13.1; 404/6, 404/9, 10

(56) References Cited

U.S. PATENT DOCUMENTS

| | | | | |
|---|---|---|---|---|
| 79,141 | A | 6/1868 | Farlin | |
| 398,078 | A | 2/1889 | Peterson | |
| 446,852 | A | 2/1891 | Davis | |
| 629,185 | A | 7/1899 | Arnold | |
| 1,329,492 | A | 2/1920 | Babcock | |
| 1,335,302 | A | 3/1920 | Stout | |
| 1,473,118 | A | 11/1923 | Miller-Masury | |
| 1,677,796 | A | 7/1928 | Parks | 248/548 |
| 2,089,929 | A | 8/1937 | Brickman et al. | 356/13.1 |

(Continued)

FOREIGN PATENT DOCUMENTS

| | | | |
|---|---|---|---|
| AT | 278890 | 2/1970 | E01F/15/00 |
| AU | 603003 | 3/1989 | E01F/13/00 |
| AU | A021844/88 | 11/1990 | E01F/13/00 |
| DE | 1 916 361 | 3/1963 | |
| DE | 1 916 361 | 5/1965 | |
| DE | 1534526 | 11/1965 | |

(Continued)

OTHER PUBLICATIONS

Notification of International PCT Search Report for International Patent Application No. PCT/US03/02998 filed Jan. 30, 2003 (7 pages), May 28, 2003.

U.S. Appl. No. 09/679,902, filed Oct. 5, 2000, Ross et al., entitled: *Improved Guardrail Terminals*, status is pending.

(Continued)

*Primary Examiner*—Daniel P. Stodola
*Assistant Examiner*—Michael P. Ferguson
(74) *Attorney, Agent, or Firm*—Baker Botts L.L.P.

(57) ABSTRACT

A guardrail support post includes a continuous structural member having a top edge, a bottom edge, and a generally uniform cross section from the top edge to the bottom edge. The structural member includes first and second generally parallel flanges, and a web forming a coupling between, and extending generally perpendicular to the first and second flanges. The structural member includes a lower portion for installing below grade adjacent a roadway, and an upper portion configured to be coupled with a guardrail beam. A mid portion of the structural member is disposed between the upper portion and the lower portion. In accordance with a particular embodiment of the present invention, the first and second flanges include first and second cutouts, respectively, that occur within the mid portion. The cutouts are operable to weaken the structural member about an axis generally perpendicular to the flanges without substantially weakening the structural member about an axis generally parallel to the flanges.

25 Claims, 3 Drawing Sheets

U.S. PATENT DOCUMENTS

| | | | | | |
|---|---|---|---|---|---|
| 2,091,195 | A | | 8/1937 | Dennebaum | 267/69 |
| 2,123,167 | A | | 7/1938 | Cain | 256/13.1 |
| 2,135,705 | A | | 11/1938 | Florance | 256/13.1 |
| 2,146,333 | A | | 2/1939 | Deming | 189/36 |
| 2,146,445 | A | | 2/1939 | Russert et al. | 169/29 |
| RE22,060 | E | | 4/1942 | Hayden et al. | 256/13.1 |
| 2,309,238 | A | | 1/1943 | Corey | 287/99 X |
| 2,321,988 | A | | 6/1943 | Brickman | 256/13.1 |
| 2,735,251 | A | | 2/1956 | Dlugosch | 55/159 |
| 2,776,116 | A | | 1/1957 | Brickman | 256/13.1 |
| 3,185,445 | A | | 5/1965 | Broadway | 256/13.1 |
| 3,308,584 | A | | 3/1967 | Graham | 52/98 X |
| 3,332,666 | A | | 7/1967 | Gray | 256/13.1 |
| 3,349,531 | A | | 10/1967 | Watson | 52/296 X |
| 3,385,564 | A | | 5/1968 | Persicke | 256/13.1 |
| 3,417,965 | A | | 12/1968 | Gray | 256/13.1 |
| 3,450,233 | A | | 6/1969 | Massa | 188/1 |
| 3,499,630 | A | | 3/1970 | Dashio | 256/13.1 |
| 3,519,301 | A | | 7/1970 | Somnitz | 293/1 |
| 3,521,917 | A | | 7/1970 | King | 287/111 X |
| 3,567,184 | A | | 3/1971 | Yancey | 256/13.1 |
| 3,606,222 | A | | 9/1971 | Howard | 52/98 X |
| 3,617,076 | A | | 11/1971 | Attwood | 287/51 |
| 3,637,244 | A | | 1/1972 | Strizki | 287/129 |
| 3,643,924 | A | | 2/1972 | Fitch | 256/13.1 |
| 3,680,448 | A | | 8/1972 | Ballingall et al | 52/169.12 |
| 3,693,940 | A | | 9/1972 | Kendall et al. | 256/1 |
| 3,711,881 | A | | 1/1973 | Chapman et al. | 14/71 |
| 3,768,781 | A | | 10/1973 | Walker et al. | 256/1 |
| 3,776,520 | A | | 12/1973 | Charles et al. | 256/13.1 |
| 3,820,906 | A | | 6/1974 | Katt | 403/2 |
| 3,846,030 | A | | 11/1974 | Katt | 403/2 |
| 3,856,268 | A | | 12/1974 | Fitch | 404/6 |
| 3,912,404 | A | | 10/1975 | Katt | 403/2 |
| 3,919,380 | A | | 11/1975 | Smarook et al. | 264/164 |
| 3,925,929 | A | | 12/1975 | Montgomery | 49/35 |
| 3,951,556 | A | | 4/1976 | Strizki | 403/2 |
| 3,967,906 | A | | 7/1976 | Strizki | 403/2 |
| 3,972,510 | A | | 8/1976 | Dougherty | 256/11 |
| 3,981,486 | A | | 9/1976 | Baumann | 256/13.1 |
| 3,982,734 | A | | 9/1976 | Walker | 256/13.1 |
| 4,000,882 | A | | 1/1977 | Penton | 256/13.1 |
| 4,063,713 | A | | 12/1977 | Anolick et al. | 256/13.1 |
| 4,071,970 | A | | 2/1978 | Strizki | 40/607 |
| 4,126,403 | A | | 11/1978 | Sweeney et al. | 403/2 |
| 4,183,695 | A | | 1/1980 | Wilcox | 505/6 |
| 4,190,275 | A | | 2/1980 | Mileti | 293/102 |
| 4,200,310 | A | | 4/1980 | Carney, III | 280/784 |
| 4,236,843 | A | | 12/1980 | Chisholm | 403/2 |
| 4,269,384 | A | | 5/1981 | Saeed et al. | 248/548 |
| 4,278,228 | A | | 7/1981 | Rebentisch et al. | 248/548 |
| 4,295,637 | A | | 10/1981 | Hulek | 256/13.1 |
| 4,330,106 | A | | 5/1982 | Chisholm | 256/13.1 |
| 4,351,617 | A | | 9/1982 | Landa | 400/118 |
| 4,352,484 | A | | 10/1982 | Gertz et al. | 256/13.1 |
| 4,389,134 | A | | 6/1983 | Colas | 403/263 |
| 4,399,980 | A | | 8/1983 | van Schie | 256/13.1 |
| 4,432,172 | A | * | 2/1984 | Kuykendall et al. | 52/98 |
| 4,452,431 | A | | 6/1984 | Stephens et al. | 256/13.1 |
| 4,490,062 | A | | 12/1984 | Chisholm | 403/2 |
| 4,583,716 | A | | 4/1986 | Stephens et al. | 256/13.1 |
| 4,607,824 | A | | 8/1986 | Krage et al. | 256/13.1 |
| 4,645,375 | A | | 2/1987 | Carney, III | 404/6 |
| 4,646,489 | A | | 3/1987 | Feller et al. | 52/165 |
| 4,655,434 | A | | 4/1987 | Bronstad | 256/13.1 |
| 4,674,911 | A | | 6/1987 | Gertz | 404/6 |
| 4,678,166 | A | | 7/1987 | Bronstad et al. | 256/13.1 |
| 4,729,690 | A | | 3/1988 | Lavender et al. | 404/10 |
| 4,784,515 | A | | 11/1988 | Krage et al. | 404/6 |
| 4,815,565 | A | | 3/1989 | Sicking et al. | 188/32 |
| 4,838,523 | A | | 6/1989 | Humble et al. | 256/13.1 |
| 4,852,847 | A | | 8/1989 | Pagel | 248/548 |
| 4,923,319 | A | | 5/1990 | Dent | 403/2 |
| 4,926,592 | A | | 5/1990 | Nehls | 52/98 |
| 4,928,446 | A | | 5/1990 | Alexander, Sr. | 42/98 |
| 4,928,928 | A | | 5/1990 | Buth et al. | 256/13.1 |
| 4,986,687 | A | | 1/1991 | Ivey | 403/2 |
| 5,011,326 | A | | 4/1991 | Carney, III | 404/6 |
| 5,022,782 | A | | 6/1991 | Gertz et al. | 404/6 |
| 5,054,954 | A | | 10/1991 | Cobb et al. | 404/6 |
| 5,069,576 | A | | 12/1991 | Pomero | 404/6 |
| 5,078,366 | A | | 1/1992 | Sicking et al. | 256/13.1 |
| 5,112,028 | A | | 5/1992 | Laturner | 256/13.1 |
| 5,203,543 | A | | 4/1993 | Fleury | 256/13.1 |
| 5,214,886 | A | | 6/1993 | Hughron | 52/98 |
| 5,244,101 | A | | 9/1993 | Palmer et al. | 211/5 |
| 5,248,129 | A | | 9/1993 | Gertz | 256/13.1 |
| 5,286,137 | A | | 2/1994 | Cincinnati et al. | 404/6 |
| 5,391,016 | A | | 2/1995 | Ivey et al. | 404/6 |
| 5,403,112 | A | | 4/1995 | Carney, III | 404/6 |
| 5,407,298 | A | | 4/1995 | Sicking et al. | 404/6 |
| 5,481,835 | A | | 1/1996 | Bloom | 52/98 |
| 5,484,217 | A | | 1/1996 | Carroll et al. | 403/2 |
| 5,503,495 | A | | 4/1996 | Mak et al. | 404/6 |
| 5,547,309 | A | | 8/1996 | Mak et al. | 404/6 |
| 5,647,520 | A | | 7/1997 | McDaid | 224/425 |
| 5,657,966 | A | | 8/1997 | Cicinnati | 256/13.1 |
| 5,660,375 | A | | 8/1997 | Freeman | 256/13.1 |
| 5,664,905 | A | | 9/1997 | Thompson et al. | 256/13.1 X |
| 5,733,062 | A | | 3/1998 | Oberth et al. | 404/6 |
| 5,746,419 | A | | 5/1998 | McFadden et al. | 267/140 |
| 5,765,811 | A | | 6/1998 | Alberson et al. | 256/13.1 |
| 5,775,675 | A | | 7/1998 | Sicking et al. | 256/13.1 |
| 5,797,591 | A | | 8/1998 | Krage | 256/13.1 |
| 5,797,592 | A | | 8/1998 | Machado | 256/13.1 |
| 5,823,584 | A | | 10/1998 | Carney, III | 293/102 |
| 5,832,762 | A | | 11/1998 | McDaid | 70/455 |
| 5,851,005 | A | | 12/1998 | Muller et al. | 256/13.1 |
| 5,855,443 | A | | 1/1999 | Faller et al. | 403/2 |
| 5,924,680 | A | | 7/1999 | Sicking et al. | 256/13.1 |
| 5,931,448 | A | | 8/1999 | Sicking et al. | 256/13.1 |
| 5,957,435 | A | | 9/1999 | Bronstad | 256/13.1 |
| 5,966,867 | A | | 10/1999 | Downer et al. | 47/46 |
| 5,988,598 | A | | 11/1999 | Sicking et al. | 256/13.1 |
| 5,992,828 | A | | 11/1999 | Burdick | 256/10 |
| 6,007,269 | A | * | 12/1999 | Marinelli | 404/6 |
| 6,022,003 | A | | 2/2000 | Sicking et al. | 256/13.1 |
| 6,065,894 | A | | 5/2000 | Wasson et al. | 403/2 |
| 6,092,959 | A | | 7/2000 | Leonhardt et al. | 404/6 |
| 6,109,597 | A | | 8/2000 | Sicking et al. | 256/13.1 |
| 6,116,805 | A | | 9/2000 | Gertz | 403/13.1 |
| 6,129,342 | A | | 10/2000 | Bronstad | 256/13.1 |
| 6,168,346 | B1 | | 1/2001 | Ernsberger | 404/6 |
| 6,203,079 | B1 | | 3/2001 | Breed | 293/119 |
| 6,210,066 | B1 | | 4/2001 | Dent | 403/2 |
| 6,220,575 | B1 | | 4/2001 | Lindsay et al. | 256/13.1 |
| 6,244,571 | B1 | | 6/2001 | Reid et al. | 256/13.1 |
| 6,254,063 | B1 | | 7/2001 | Rohde et al. | 256/13.1 |
| 6,260,827 | B1 | | 7/2001 | Sicking et al. | 256/13.1 |
| 6,272,796 | B1 | | 8/2001 | Metzler | 52/93.1 |
| 6,290,427 | B1 | | 9/2001 | Ochoa | 404/6 |
| 6,299,141 | B1 | * | 10/2001 | Lindsay et al. | 256/13.1 |
| 6,308,809 | B1 | | 10/2001 | Reid et al. | 188/377 |
| 6,340,268 | B1 | | 1/2002 | Alberson et al. | 404/6 |
| 6,347,904 | B1 | | 2/2002 | Knighton | 403/400 |
| 6,398,192 | B1 | * | 6/2002 | Albritton | 256/13.1 |
| 6,409,156 | B2 | | 6/2002 | Dent | 256/13.1 |
| 6,416,041 | B1 | | 7/2002 | Sicking et al. | 256/13.1 |
| 6,435,761 | B1 | | 8/2002 | Bligh et al. | 404/6 |
| 6,461,076 | B1 | | 10/2002 | Stephens et al. | 404/6 |
| 6,488,268 | B1 | * | 12/2002 | Albritton | 256/13.1 |

| | | | | |
|---|---|---|---|---|
| 6,554,256 | B2 * | 4/2003 | Ochoa | 256/13.1 |
| 6,609,343 | B1 | 8/2003 | Litten | 52/653.2 |
| 6,637,971 | B1 | 10/2003 | Carney, III et al. | 404/6 |
| 6,644,888 | B2 | 11/2003 | Ochoa | 404/6 |
| 2001/0013596 | A1 | 8/2001 | Sicking et al. | |
| 2001/0048101 | A1 | 12/2001 | Bligh et al. | 256/13.1 |
| 2002/0007994 | A1 | 1/2002 | Reid et al. | |
| 2002/0179894 | A1 | 12/2002 | Albritton | 256/13.1 |
| 2003/0015695 | A1 | 1/2003 | Alberson et al. | 256/13.1 |
| 2003/0168650 | A1 | 9/2003 | Alberson et al. | 256/13.1 |
| 2003/0213946 | A1 | 11/2003 | Alberson et al. | 256/13.1 |
| 2003/0215305 | A1 | 11/2003 | Alberson et al. | 411/400 |

FOREIGN PATENT DOCUMENTS

| | | | | |
|---|---|---|---|---|
| DE | 1459803 | | 3/1969 | |
| DE | 3708861 | | 10/1988 | E01F/15/00 |
| EP | 0245042 | | 4/1987 | E01F/15/00 |
| EP | 0 245 042 | | 11/1987 | E01F/15/00 |
| EP | 0 924 347 | A1 | 6/1999 | E01F/15/14 |
| EP | 0 952 256 | A2 | 10/1999 | E01F/15/14 |
| FR | 2 386 6678 | | 4/1977 | E04H/12/22 |
| FR | 77 11540 | | 3/1978 | E04H/12/22 |
| FR | 2546932 | | 6/1983 | E01F/15/00 |
| GB | 2023695 | A | 1/1980 | |
| JP | 10 18255 | | 1/1988 | |
| LU | 40465 | | 10/1961 | |
| LU | 41444 | | 5/1962 | |
| WO | WO 96/20311 | | 4/1996 | |
| WO | 98/50637 | | 12/1998 | E01F/15/04 |
| WO | 00/40805 | | 7/2000 | E01F/15/04 |

OTHER PUBLICATIONS

"*INFORMATION: Report 350 Acceptance of New York 3–Strand Cable Terminal*", Memorandum No. HMH-S–CC63 from Dwight A. Horne, Director, Office Highway Safety Infrastructure, U.S. Department of Transportation, Federal Highway Administration, to Resource Center Directors, Division Administrators and Federal Lands Highway Division Engineers, 2 pages Memorandum and 3 pages of Attachments (Feb. 14, 2000).

PCT Written Opinion for International Application No. PCT/US03/15002, filed May 13, 2003, Apr. 28, 2004.

"Road Restraint Systems—Part 4: Barrier Systems . . . ", European Standard, Draft, PrEN 1317–4, Jun. 17–18th, 1999, European Committee for Standardisation, Doc No: 226/WG1/TG1/041, Contral Secretariat: rue de Stassart 36, B 6 1050 Brussels.

"Road Restraint Systems—Part 4: Performance Classes . . . ", British Standard, Oct. 18, 2002, © BSI, ENV 1317–4:2001 (E).

"Recommended Procedures for the Safety Performance Evaluation of Highway Features", NCHRP Report 350, National Cooperative Highway Research Program, Transportation Research Board.

International Preliminary Examination Report for PCT/US99/30463, Apr. 24, 2001.

International Preliminary Examination Report for PCT/US98/09029, Jul. 12, 2000.

International Search Report for PCT/US99/30463, Apr. 28, 2000.

International Search Report for PCT/US98/09029, Sep. 1, 1998.

Written Opinion for PCT/US99/30463, Nov. 22, 2000.

Written Opinion for PCT/US98/09029, Mar. 29, 2000.

ET–2000 The Future of Highway Safety—SYRO (Printed in Dec. 1990; revised Oct. 1992).

Bronstad, et al., *Modified Breakaway Cable Terminals for Guardrails and Median Barriers*, Research Results Digest, NCHRP, Transportation Research Board, Digest 12, May 1978.

*Breakaway Metal Post for Highway Guardrail End Treatments* U.S. Appl. No. 09/074,496, filed May 7, 1998, James R. Albritton.

*Breakaway Support Post for Highway Guardrail End Treatments* U.S. Appl. No. 09/358,017, filed Jul. 19, 1999, James R. Albritton.

U.S. Appl. No. 09/943,727, filed Aug. 31, 2001, by Bligh et al., and entitled *ET–PLUS: Head Assembly for Guardrail Extruder Terminal.*

PCT International Search Report in International Application No. PCT/US 02/38385, dated Mar. 20, 2003, 6 pages.

Notification of Transmittal of The International Search Report, PCT application No. PCT/US03/15002, date of mailing Aug. 14, 2003 referencing the above cited art.

"BEAT Box Beam Bursting Energy Absorbing Terminal", RSI Road Systems, Inc., http://www.roadsystems.com/beat.htm.

* cited by examiner

STEEL YIELDING GUARDRAIL SUPPORT POST

RELATED APPLICATION

This application claims the benefit of U.S. Provisional Application Ser. No. 60/334,286 filed Nov. 30, 2001.

TECHNICAL FIELD OF THE INVENTION

The present invention relates generally to guardrail systems and more particularly, to a steel yielding guardrail support post.

BACKGROUND OF THE INVENTION

Guardrail systems are widely used along heavily traveled roadways to enhance the safety of the roadway and adjacent roadside. Guardrail beams and their corresponding support posts are employed to accomplish multiple tasks. Upon vehicle impact, a guardrail acts to contain and redirect the errant vehicle.

For many years, a standard heavy gauge metal guardrail known as the "W-beam" has been used on the nation's roadways to accomplish these tasks and others. Named after its characteristic shape, the "W-beam" is typically anchored to the ground using posts made of metal, wood or a combination of both.

Wood posts are more readily available and more economical than metal posts in some geographical areas. In other areas, metal (e.g., steel) posts are more readily available and more economical, and are preferred for their ease of installation using driving methods.

Wood posts used in a terminal portion of a guardrail have been made to break away upon impact, thus producing a desired behavior during a collision by a vehicle at the end of the terminal section. However, in some environments, wood posts deteriorate more rapidly and alternate materials are sought. Commonly used steel posts do not break away in the desired fashion, and are not suitable for use in the terminal section of a guardrail system.

Break away steel support posts that are modified to allow for failure during a collision have recently become available. Examples include a "hinged breakaway post" and the "energy absorbing breakaway steel guardrail post" described in U.S. Pat. No. 6,254,063. Many such prior attempts require substantial time, money, and resources during fabrication, modification, and/or installation.

SUMMARY OF THE INVENTION

A guardrail support post is provided, for use in securing guardrail beams adjacent roadways. The guardrail support post has been modified to weaken the support post along a direction generally parallel to the flow of traffic. This allows for failure, or yielding of the guardrail support post during a head-on collision of a vehicle with a guardrail terminal, or other guardrail section. Accordingly, the support posts of a guardrail system will yield as a vehicle impacts consecutive support posts, and absorb kinetic energy of the vehicle, until the vehicle is brought to a stop.

In accordance with a particular embodiment of the present invention, a guardrail support post includes a continuous structural member having a top edge, a bottom edge, and a generally uniform cross section from the top edge to the bottom edge. The structural member includes first and second generally parallel flanges, and a web forming a coupling between, and extending generally perpendicular to the first and second flanges. The structural member may have a lower portion for installing below grade adjacent a roadway, and an upper portion configured to be coupled with a guardrail beam. A mid portion of the structural member is disposed between the upper portion and the lower portion. In accordance with at least one embodiment of the present invention, the first and second flanges include first and second cutouts, respectively, that occur within the mid portion. The cutouts may be operable to weaken the structural member about the axis generally perpendicular to the flanges without excessively weakening the structural member about an axis generally parallel to the flanges.

In accordance with another embodiment of the present invention, each of the cutouts includes a vertical dimension and a horizontal dimension. A ratio of the vertical dimension to the horizontal dimension may be approximately equal to or less than one.

In accordance with yet another embodiment of the present invention, the cutouts comprise generally circular cutouts. Each generally circular cutout may include a diameter of approximately thirteen millimeters.

In accordance with still another embodiment of the present invention, the generally circular cutouts may be sized approximately equal to bolt holes configured to receive fasteners for coupling the guardrail beam with the support member. For example, the generally circular cutouts may include a diameter of approximately twenty-one millimeters.

Technical advantages of particular embodiments of the present invention include a guardrail support post that is weakened about a "weak axis" such that the guardrail support post will fail or yield during a head-on collision with a terminal section of the guardrail. The guardrail support post may also have sufficient strength to redirect vehicles that collide along the length of the guardrail system at an angle to the flow of traffic.

Another technical advantage of particular embodiments of the present invention includes a support post that has been weakened at a particular point along its mid section. This allows the most likely point of failure of the support post during a head-on collision (parallel to the direction of traffic) to be predetermined and/or controlled.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which.

DETAILED DESCRIPTION OF THE INVENTION

Figure 1:
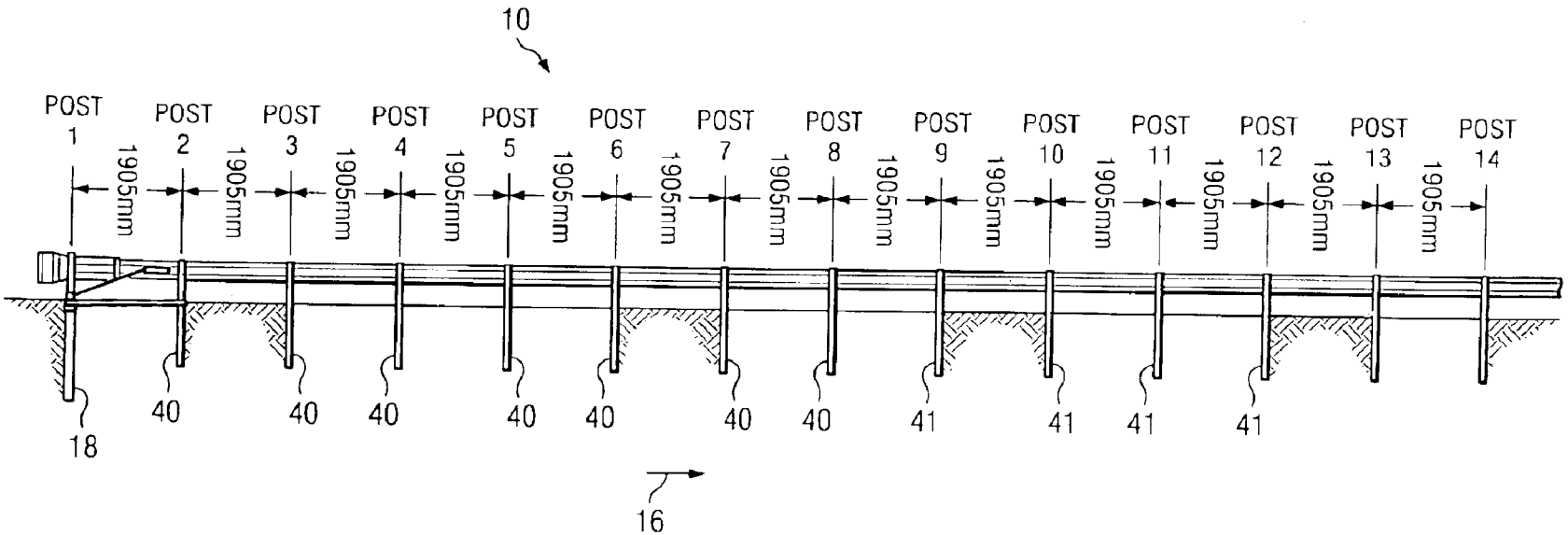
FIG. 1 illustrates a side view of a guardrail system that incorporates aspects of the present invention.
Figure 2:
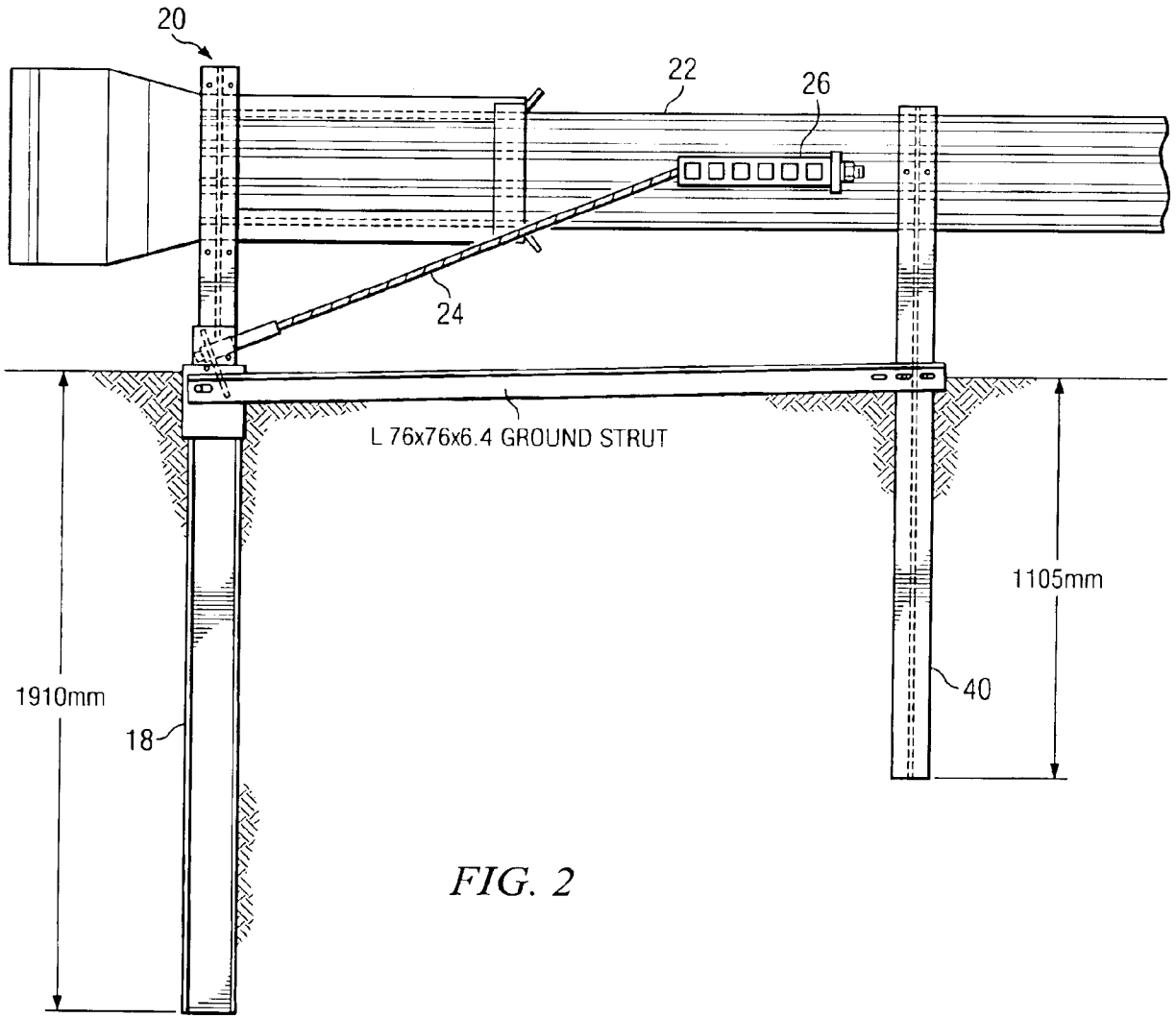
FIG. 2 is a side view, with portions broken away, illustrating an enlarged section of a portion of the guardrail system of FIG. 1.

FIGS. 1 and 2 illustrate portions of a guardrail safety system 10 that incorporates aspects of the present invention. Guardrail system 10 may be installed adjacent a roadway, to protect vehicles, drivers and passengers from various obstacles and hazards, and prevent vehicles from leaving the roadway during a traffic accident or other hazardous condition. Guardrail systems incorporating aspects of the present invention may be used in median strips or shoulders of highways, roadways, or any path that is likely to encounter vehicular traffic. Guardrail system 10 includes a guardrail beam 12, and support posts 14 that anchor guardrail beam 12 in place along the roadway.

In accordance with the teaching of the present invention, support posts 14 have been modified to decrease the strength of support posts 14 in a direction generally parallel to axis 16 (generally along the direction of traffic) without substantially decreasing its strength in a direction generally perpendicular to axis 16 (out of the page in FIG. 1). Accordingly, if a vehicle impacts guardrail system 10 "head-on" adjacent terminal post 18, support posts 14 will tend to fail (e.g., buckle), while allowing the vehicle to decelerate as it impacts consecutive support posts. However, if a vehicle strikes guardrail system 10 along the face of and at an angle to guardrail beam 12, support posts 14 will provide sufficient resistance (strength) to redirect the vehicle along a path generally parallel with guardrail beam 12.

Guardrail system 10 is intended to keep errant vehicles from leaving the roadway during a crash or other hazardous situation. In many instances, guardrail 10 is installed between a roadway and a significant hazard to vehicles (e.g., another roadway, a bridge, cliff, etc.). Therefore, guardrail system 10 should be designed to withstand a significant impact from a direction generally perpendicular to the roadway, without substantial failure. It is this strength that allows guardrail system 10 to withstand the impact, and still redirect the vehicle so that it is once again traveling generally in the direction of the roadway.

However, testing and experience has continuously shown that guardrail systems may actually introduce additional hazards to the roadway and surrounding areas. This is particularly true with respect to vehicles that impact the guardrail system adjacent its terminal section, in a direction generally parallel to the roadway. For example, if the guardrail system were rigidly fixed in place during a crash, serious injury and damage may result to the errant vehicle, its driver and passengers. Accordingly, many attempts have been made to minimize this added risk.

One such method used to reduce the frequency and amount of damage/injury caused by head on collisions with a guardrail system included a terminal portion that was tapered from the ground up. This effectively reduced the impact of head on collisions, but also created a ramp-like effect that caused the vehicles to go airborne during a crash.

Other methods include breakaway cable terminals (BCT), vehicle attenuating terminals (VAT), SENTRE end treatments, breakaway end terminals (BET) and the breakaway support posts of U.S. Pat. No. 6,398,192 ("'192 Patent"). Many such terminals, supports, end treatments and the like are commercially available from various organizations. Examples include the HBA post by Exodyne Technologies and Trinity Industries, and a breakaway support post similar in configuration to that described in the '192 Patent.

FIG. 2 illustrates a portion of the terminal section of guardrail system 10, in more detail. This is referred to the terminal section since the guardrail section terminates at this point. The terminal section includes an end terminal assembly 20 that is specially configured to absorb the impact of a head on collision, to minimize damage and injury caused by such a collision.

End terminal assembly 20 is anchored to the ground using break away terminal post 18. End terminal assembly 20 is slidably coupled with a section of guardrail beam 22. Terminal post 18 is coupled with guardrail beam 22 using a cable 24 and coupling assembly 26. A ground strut 28 couples terminal post 18 with guardrail support post 40. As discussed above, guardrail support post 40 is configured to break away when a significant force is applied along its weak direction. The specifics of guardrail support post 40 will be addressed in more detail with respect to FIGS. 3 and 4.

Referring again to FIG. 1, guardrail system 10 includes one terminal post 18, and seven guardrail support posts 40. Collectively, this configuration forms the terminal section of guardrail system 10. Standard guardrail support posts 41 may be used for the balance of guardrail system 10. However, it should be recognized by those of ordinary skill in the art that support post 40 described herein is suitable for installation at any location within a guardrail system, within the teachings of the present invention.

Figure 3A:
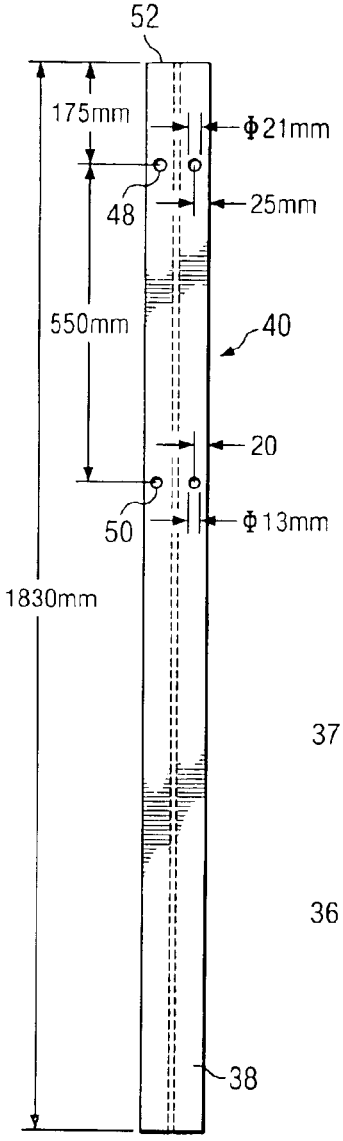
FIG. 3 illustrates a guardrail support post suitable for use with the guardrail system of FIG. 1, in accordance with a particular embodiment of the present invention.
Figure 3B:
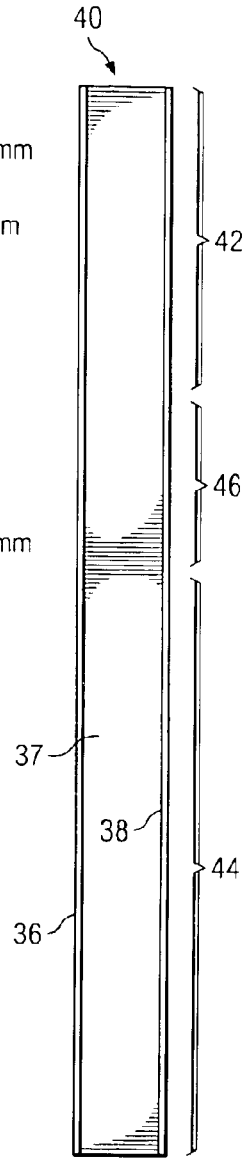
Figure 3C:
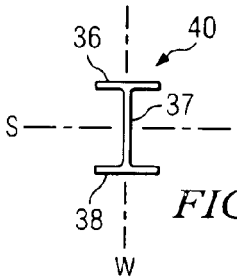

FIG. 3 illustrates a guardrail support post 40, in accordance with a particular embodiment of the present invention. Support post 40 includes an elongate, continuous structural member of a standard Wide flange configuration. Support post 40 includes two flanges 36 and 38, that are generally parallel with one another, and in a spaced relation. A web 37 forms the coupling between flanges 36 and 38. Flanges 36 and 38 include a generally identical configuration of boltholes 48 and cutouts 50, therein.

With regard to a Wide flange shape used as a guardrail post, the cross section is typically shaped like the letter "H". The cross section has two major axes for bending. The "weak" axis generally refers to a central axis that extends through the web and is perpendicular to the flanges. The "strong" axis generally refers to a central axis that is perpendicular to the web and parallel to the planes of the flanges. The weak axis for a conventional installation of guardrail extends generally transversely to the road. The strong axis extends generally along the roadway.

In the illustrated embodiment of FIG. 3, the Wide flange is a standard W6×9, which is commonly used in fabricating support posts for guardrail installations. In fact, one advantage of the present invention is the ability to re-use existing, standard equipment to fabricate, modify, and install support post 40, without substantial modification to the equipment. Those of ordinary skill in the art will recognize that wide flange beams may be available in many different sizes. For example, a standard W6×9 Wide flange may have a nominal six-inch depth and weigh nine pounds per foot. However, a Wide flange having a six-inch depth and weighing eight and one-half pounds per foot may also be referred to as a W6×9 Wide flange and they are considered equivalent in the trade. The term "W6×9 Wide flange" is intended to refer to all sizes and configurations of guardrail posts that may be referred to as "W6×9" by a person of ordinary skill in the art. In addition, persons skilled in the art recognize other names used for wide flanges include but are not limited to "I-beam," "H-beam," "W-beam," "S-beam," "M-beam," or the term "shape" may be substituted for "beam."

Support post 40 includes a relatively "weak" axis W, and a relatively "strong" axis S. For the reasons described above, support post 40 is normally installed along a roadway such that weak axis W is generally perpendicular to the direction of traffic, and strong axis S is generally parallel to the direction of traffic. Accordingly, support post 40 is typically able to withstand a significant impact (e.g., with a car travelling at a high rate of speed) about the strong axis S without substantial failure. However, support post 40 is intentionally designed such that failure will more readily occur in response to an impact about the weak axis W.

Support post 40 is approximately 1,830 mm long, and includes an upper portion 42, a lower portion 44, and a mid portion 46 which couples upper portion 42 with lower portion 44. Upper portion 42 includes two boltholes 48 that are adapted to receive connectors for the installation of a guardrail beam (e.g., guardrail beam 12) upon support post 40. Lower portion 44 is suitable for installation below grade, as part of a guardrail support system. Mid portion 46 includes two cutouts 50, which are configured to further weaken support post 40 about the weak axis W, to more readily allow for failure due to impact from a vehicle along that direction. The overall length of support post 40, and its upper, lower and mid portions may vary significantly, within the teachings of the present invention.

Bolt holes 48 include a standard configuration that allow for the installation of widely used guardrail beams, upon support posts 40. In general, bolt holes 48 align with the center of the guardrail beam, and maintain the center of the guardrail beam approximately five hundred and fifty millimeters above grade. However, the number, size, location and configuration of boltholes 48 may be significantly modified, within the teachings of the present invention.

Cutouts 50 are positioned within mid portion 46 to weaken support post 40 about weak axis W, adjacent grade (when installed). This will accommodate failure of support post 40 approximately at grade, allowing support post 40 to "fold" over from the point of failure, upward. Since lower portion 44 is below grade, it is not expected that the ground, or lower portion 44 of support post 40 will appreciably deflect during an impact.

Since cutouts 50 are intended to occur approximately at grade, and the center of bolt holes 48 are intended to occur five hundred and fifty millimeters above grade, bolt holes 48 occur five hundred and fifty millimeters above cutouts 50, in the illustrated embodiment. It will be recognized by those of ordinary skill in the art that the size, configuration, location and number of bolt holes, cutouts, and their relationship with each other, may be varied significantly within the teachings of the present invention.

In the illustrated embodiment of FIG. 3, cutouts 50 occur approximately seven hundred and twenty-five millimeters below a top edge 52 of support post 40. However, the location of cutouts 50 may vary in accordance with the teachings of the present invention. The configuration of FIG. 3 envisions that cutouts 50 will occur approximately at grade level. In other embodiments, cutouts 50 may occur below grade or above grade. The depth of cutouts 50 below grade should not exceed an amount that will prevent support post 40 from failing at or near the location of cutouts 50. At some depth below grade, the surrounding earthen (or other) material will reinforce lower portion 44 of support post 40 to an extent that will no longer accommodate such failure to occur.

The height of cutouts 50 above grade should not exceed a point at which support post 40 will fail at cutouts 50, and leave a "stub" above grade which can snag vehicles, and otherwise cause excessive injury and/or excessive damage. Such a stub could be detrimental to the redirective effect of the guardrail system in which support post 40 is operating.

As described above, several attempts have been made in the past to allow for failure of a terminal guardrail post in the weak direction. Such attempts often include two-piece sections of support post that are welded or otherwise fastened together using plates, bolts etc. Such efforts have been focused upon accommodating failure of the support post at a certain area of the support post, when impacted in the weak direction. The present invention provides an enhanced alternative to such techniques.

For example, support post 40 is a single, continuous structural member that does not require any labor in field assembly, welding, or special handling. With the exception of boltholes 48 and cutouts 50, support post 14 has a continuous, generally uniform cross-section from top edge 52, to bottom edge 54. Therefore, fabrication of support post 40 is simplified, with respect to other multiple component products. Furthermore, support post 40 can be shipped as one piece, and installed as one piece. Many prior attempts that included multiple components that were hinged, or otherwise connected could not be shipped, and/or installed as a single unit without damaging the support post.

Similarly, many such prior efforts required specialized equipment for proper installation, and often required a significant amount of field labor to perform such installation. In contrast, support post 40 of the present invention can be installed using traditional guardrail post installation equipment (e.g., guardrail post drivers).

Cutouts 50 of support posts 40 are configured to reduce the strength of support post 40 about weak axis W, without substantially weakening support post 40 about strong axis S. In the illustrated embodiment, cutouts 50 comprise generally circular openings that have been punched or drilled through support post 40.

Previous attempts to accommodate failure of a guardrail support post have often weakened the support post about the strong axis S, which impacts the support post's ability to redirect a vehicle that collides with the support in a direction generally perpendicular to the roadway. For this reason, such support posts may be unacceptable for use along a roadway, and may fail to comply with governing federal standards bodies' requirements.

Patent Application PCT/US98/09029 ('029 Application) illustrates a support post having slotted openings disposed therein. These slots are substantially longer (vertically) than they are wide (horizontal).

Cutouts 50 provide an enhanced ability to control the point of failure of support post 40 during a collision with a vehicle. For example, the support post of the '029 Application may fail at any point along the slots, and failure may be based upon imperfections in the material adjacent the slots. By limiting the vertical dimension of cutout 50, it is easier to dictate the precise point of failure of support post 40 along its vertical length.

Furthermore, the slots of the '029 Application require the removal of a substantial amount of material from the flange. This weakens the flange along directions other than perpendicular to the web. Furthermore, during a dynamic crash situation, in which the impact may come from any angle, twisting or bending of the flange may result in the flange changing its orientation in response to the initial impact. Accordingly, the support post having vertical slots similar to the '029 Application may fail prematurely along the strong axis and lose its ability to redirect the vehicle.

In accordance with the teachings of the present invention, the vertical dimension of cutout 50 is limited based upon the horizontal dimension of cutout 50. For example, a ratio of the vertical dimension of any particular cutout may be equal to, or less than three times the horizontal dimension. Alternatively, the ratio may be limited to two times the horizontal dimension. In the illustrated embodiment of FIG. 3, the ratio is 1:1, since cutout 50 is generally a circular opening in the support post. The smaller the vertical dimension of the cutout, the more precisely the designer may dictate the point of failure along the vertical length of support post 40.

Various configurations of cutouts 50 are available to a designer of support post 40, in accordance with the teachings of the present invention. For example, rather than circular openings, cutouts 50 may comprise square, rectangular, triangular, oval, diamond shaped, or practically any other geometric configuration, and still obtain some or all of the benefits described herein.

The horizontal orientation of cutouts 50 within flanges 36 and 38 may also be altered significantly, within the teachings of the present invention. In the illustrated embodiment of FIG. 3, cutouts 50 are located approximately twenty millimeters from outer edges of flanges 36 and 38. However, in alternative embodiments, cutouts 50 may be located closer to such edges, or further from such edges. In one embodiment, cutouts 50 may be configured such that they extend all the way to the edge of the flange, such that there is a break in material beginning at the edge. In this manner, a traditional punch could be employed at the edge, to form a semi-circular opening that extends to the edge of the flange.

Alternatively, a sawcut could be employed from the outer edge of the flange, and extending inward, to form cutouts 50. In this manner, the sawcut would form the starting point of the likely point of failure along the weak axis of the support post. Rather than a sawcut, a similar configuration may include a slot in which the longest dimension extends horizontally through the flange. Such a slot may begin or terminate at the edge of the flange, or otherwise be disposed completely within the material of the flange.

Figure 4A:
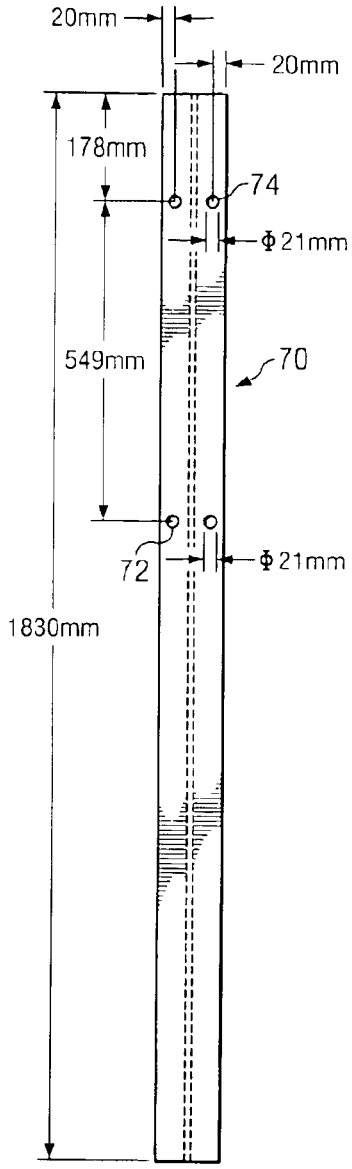
FIG. 4 illustrates another guardrail support post suitable for use with the guardrail system of FIG. 1, in accordance with another embodiment of the present invention.
Figure 4B:
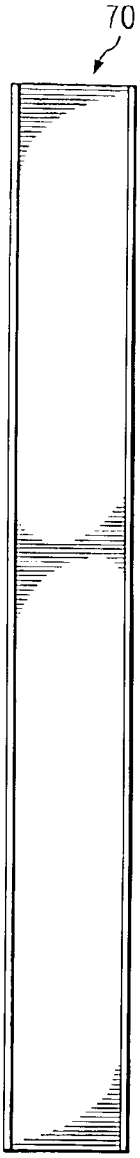
Figure 4C:
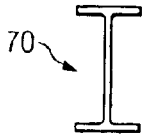

FIG. 4 illustrates a support post 70, in accordance with another embodiment of the present invention. Support post 70 is a W8×10 Wide flange, and is therefore slightly larger and heavier than the W6×9 Wide flange of FIG. 3. Support post 70 is very similar in configuration to support post 40, although many of the dimensions of relative aspects and components are slightly different. Therefore, support post 70 will not be described in significant detail.

Cutouts 72 of support post 70 are slightly larger than cutouts 50 of FIG. 3. In the illustrated embodiment of FIG. 4, cutouts 72 are approximately twenty-one millimeters in diameter. In this configuration, cutouts 72 are the same size as boltholes 74. Accordingly, fabrication of support post 70 is simplified, since the same tools that are used to punch bolt holes 74 may be used to punch cutouts 72. Tooling costs are thereby reduced, since the tools need only be re-indexed to provide additional holes for cutouts 72.

Two types of guardrail support members are described and illustrated within this specification: (I) W6×9; and (II) W8×10 Wide flanges. It should be recognized by those of ordinary skill in the art that practically any size guardrail support post may be enhanced by incorporating the teachings of the present invention. The size, weight and configuration of the support post are just a few factors to be considered to determine the appropriate location of cutouts, to allow failure along the weak axis, while maintaining sufficient strength along the strong axis to redirect impacting vehicles.

Although the present invention has been described by several embodiments, various changes and modifications may be suggested to one skilled in the art. It is intended that the present invention encompass such changes and modifications as fall within the scope of the present appended claims.

What is claimed is:

1. A guardrail support post, comprising:

a continuous structural member having a top edge, a bottom edge, and a generally uniform continuous cross section extending from the top edge to the bottom edge, the structural member including first and second generally parallel flanges, and a web forming a coupling between, and extending generally perpendicular to the first and second flanges;

the structural member having a lower portion installed below grade adjacent a roadway, an upper portion directly coupled with a guardrail beam, and a mid portion between the upper portion and the lower portion;

wherein the first and second flanges include first and second cutouts, respectively, that occur within the mid portion; wherein each of the cutouts are spaced from respective outer edges of the first and second flanges approximately at grade; and wherein each of the first and second cutouts include a vertical dimension and a horizontal dimension, a ratio of the vertical dimension to the horizontal dimension approximately equal to or less than two.

2. The guardrail support post of claim 1, wherein the cutouts comprise generally circular cutouts.

3. The guardrail support post of claim 2, wherein the generally circular cutouts each include a diameter of approximately twenty-one millimeters.

4. The guardrail support post of claim 2, wherein the generally circular cutouts each include a diameter of approximately 13 millimeters.

5. The guardrail support post of claim 1, wherein the structural member comprises a W8×10 wide flange.

6. The guardrail support post of claim 5, wherein each of the cutouts are spaced approximately twenty millimeters from respective outer edges of the first and second flanges.

7. The guardrail support post of claim 5, wherein the cutouts are spaced approximately seven hundred and twenty-seven millimeters from the top edge of the structural member.

8. The guardrail support post of claim 5, wherein the upper portion of the structural member further comprises a plurality of bolt holes configured to receive fasteners for coupling the guardrail beam with the structural member.

9. The guardrail support post of claim 8, wherein the bolt holes are spaced approximately five hundred and fifty millimeters from the cutouts.

10. The guardrail support post of claim 1, wherein the structural member comprises a W6×9 wide flange.

11. The guardrail support post of claim 10, wherein each of the cutouts are spaced approximately twenty millimeters from respective outer edges of the first and second flanges.

12. The guardrail support post of claim 10, wherein the cutouts are spaced approximately seven hundred and twenty-five millimeters from the top edge of the structural member.

13. The guardrail support post of claim 10, wherein the structural member further comprises a plurality of bolt holes configured to receive fasteners for coupling the guardrail beam with the structural member, and wherein the bolt holes are spaced approximately five hundred and fifty millimeters from the cutouts.

14. A guardrail support system, comprising:

a continuous structural member including a wide flange having first and second generally parallel flanges, and a web portion forming a coupling between the first and second flanges, and maintaining the first and second flanges in a spaced relationship;

the structural member having a top edge, a bottom edge, and a generally uniform continuous cross section extending from the top edge to the bottom edge;

the structural member having a lower portion installed below grade adjacent a roadway, an upper portion receiving fasteners, directly coupling a guardrail beam to the structural member, and a mid portion disposed between the upper portion and the lower portion;

the first flange including first and second cutouts disposed approximately twenty millimeters from opposing outer edges of the first flange approximately at grade;

the second flange including third and fourth cutouts disposed approximately twenty millimeters from opposing outer edges of the second flange approximately at grade;

wherein each of the first, second, third and fourth cutouts includes a vertical dimension and a horizontal dimension, and a respective ratio of the vertical dimension to the horizontal dimension; and each of the ratios is approximately equal to, or less than two.

15. The guardrail support system of claim 14, wherein the structural member comprises a W6×9 wide flange.

16. The guardrail support system of claim 14, wherein the structural member comprises a W8×10 wide flange.

17. The guardrail support system of claim 14, wherein the cutouts comprise circular cutouts, each circular cutout having a diameter of approximately 20 millimeters.

18. The guardrail support system of claim 14, wherein the cutouts comprise circular cutouts, each circular cutout having a diameter of approximately 13 millimeters.

19. The guardrail support system of claim 14, further comprising the guardrail beam coupled with the structural member.

20. The guardrail support system of claim 19, wherein the guardrail beam and the structural member form a portion of a guardrail terminal section.

21. A guardrail system, comprising:

an energy absorbing end terminal treatment;

a cable release post coupled with the end terminal treatment and installed at least partially below grade adjacent the end terminal treatment;

the end terminal treatment being slidably coupled with a section of guardrail beam;

a cable coupled at a first end to the cable release post and coupled at a second end to the section of guardrail beam;

a ground strut coupled at a third end to the cable release post and coupled at a fourth end to a continuous guardrail support post, the guardrail support post including first and second generally parallel flanges, and a web forming a coupling between, and extending generally perpendicular to, the first and second flanges the guardrail support post having a lower portion installed below grade adjacent a roadway, an upper portion directly coupled with the guardrail beam, and a mid portion between the upper portion and the lower portion;

the guardrail support post having a top edge, a bottom edge, and a generally uniform continuous cross section extending from the top edge to the bottom edge, the mid portion including a plurality of cutouts, each of the cutouts including a vertical dimension and a horizontal dimension, and a respective ratio of the vertical dimension to the horizontal dimension; wherein each of the cutouts are spaced from respective outer edges of the first and second flanges approximately at grade; and wherein each of the ratios is approximately equal to, or less than two.

22. The guardrail system of claim 21, wherein the guardrail support post comprises a first guardrail support post and wherein the guardrail system further comprises second, third, fourth, fifth, sixth and seventh consecutive guardrail support posts configured identically to the first guardrail support post and operable to support consecutive sections of guardrail beam.

23. A guardrail system, comprising:

a cable release post installed at least partially below grade coupled with a section of slotted guardrail beam;

a cable coupled at a first end to the cable release post and coupled at a second end to the section of guardrail beam;

a ground strut coupled at a third end to the cable release post and coupled at a fourth end to a continuous guardrail support post, the guardrail support post including first and second generally parallel flanges, and a web forming a coupling between, and extending generally perpendicular to, the first and second flanges the guardrail support post having a lower portion installed below grade adjacent a roadway, an upper portion directly coupled with the guardrail beam, and a mid portion between the upper portion and the lower portion;

the guardrail support post having a top edge, a bottom edge, and a generally uniform continuous cross section extending from the top edge to the bottom edge, the mid portion including a plurality of cutouts, each of the cutouts including a vertical dimension and a horizontal dimension, and a respective ratio of the vertical dimension to the horizontal dimension; wherein each of the cutouts are spaced from respective outer edges of the first and second flanges approximately at grade; and wherein each of the ratios is approximately equal to, or less than two.

24. The guardrail system of claim 23, wherein the guardrail system comprises a slotted rail terminal (SRT).

25. The guardrail system of claim 24, wherein the guardrail support post comprises a first guardrail support post and wherein the guardrail system further comprises second, third, fourth, and fifth consecutive guardrail support posts configured identically to the first guardrail support post and operable to support consecutive sections of guardrail beam.

* * * * *